US008276683B1

(12) United States Patent
Roy

(10) Patent No.: US 8,276,683 B1
(45) Date of Patent: Oct. 2, 2012

(54) COMBINATION POST AND INSERTION TOOL THEREFOR

(76) Inventor: Christopher H. W. Roy, Drury, MO (US)

( * ) Notice: Subject to any disclaimer, the term of this patent is extended or adjusted under 35 U.S.C. 154(b) by 0 days.

(21) Appl. No.: 12/931,270

(22) Filed: Jan. 27, 2011

Related U.S. Application Data

(63) Continuation of application No. 12/459,028, filed on Jun. 25, 2009, now abandoned.

(60) Provisional application No. 61/133,045, filed on Jun. 25, 2008, provisional application No. 61/336,800, filed on Jan. 27, 2010.

(51) Int. Cl.
*B25D 1/16* (2006.01)

(52) U.S. Cl. ..... 173/126; 173/128; 173/132; 173/91; 175/19

(58) Field of Classification Search ..... 173/126, 173/90, 91, 132, 128; 227/147; 116/209
See application file for complete search history.

(56) References Cited

U.S. PATENT DOCUMENTS

| | | | | | |
|---|---|---|---|---|---|
| 267,605 | A | | 11/1882 | Sherman | 173/126 |
| 1,521,265 | A | * | 12/1924 | Anderson | 29/275 |
| 1,646,039 | A | * | 10/1927 | Murton | 173/126 |
| 2,067,890 | A | | 1/1937 | Collord | 405/244 |
| 2,098,146 | A | * | 11/1937 | Hunt | 173/126 |
| 2,145,420 | A | * | 1/1939 | Hornbecker | 174/7 |
| 2,147,828 | A | * | 2/1939 | Daniels | 174/7 |
| 2,572,370 | A | | 10/1951 | Moeller | 173/91 |
| 2,629,985 | A | * | 3/1953 | McDowell | 173/91 |
| 3,143,817 | A | * | 8/1964 | Paulson | 40/607.06 |
| 3,694,918 | A | * | 10/1972 | Bailey et al. | 30/277 |
| 3,735,822 | A | * | 5/1973 | Deike | 173/118 |
| 4,101,088 | A | * | 7/1978 | Stauth | 242/396.1 |
| 4,261,424 | A | | 4/1981 | Gonterman et al. | 173/91 |
| 4,315,551 | A | * | 2/1982 | Iannone | 173/128 |
| 4,494,612 | A | | 1/1985 | Bell | 173/1 |
| 4,790,533 | A | | 12/1988 | Potthast, Sr. | 273/25 |
| 5,029,651 | A | * | 7/1991 | Ubbink | 175/19 |
| 5,332,047 | A | | 7/1994 | Hignite | 173/1 |
| 5,370,192 | A | * | 12/1994 | Evinger | 173/90 |
| 5,671,814 | A | | 9/1997 | Smith | 173/91 |
| 5,988,296 | A | | 11/1999 | Zachman et al. | 173/1 |
| 6,148,929 | A | * | 11/2000 | Winters | 173/91 |
| 6,261,027 | B1 | * | 7/2001 | Wentworth et al. | 405/184 |
| 6,832,575 | B2 | * | 12/2004 | Carroll, Jr. | 116/209 |
| 6,854,531 | B2 | * | 2/2005 | Jubinville | 173/90 |
| 6,899,187 | B1 | * | 5/2005 | McCarthy | 175/19 |
| 7,303,027 | B1 | | 12/2007 | Laemmer | 173/91 |
| 2005/0098087 | A1 | * | 5/2005 | Carroll | 116/209 |

* cited by examiner

*Primary Examiner* — Lindsay Low
*Assistant Examiner* — Andrew M Tecco
(74) *Attorney, Agent, or Firm* — Jonathan A. Bay

(57) ABSTRACT

A post driver for driving hollow posts, especially plastic posts, has an elongated central guide shaft and a hollow outer sleeve. The guide shaft has a length and diameter sized to pass fairly freely through but generally fill the post's hollow core to protect against the post buckling during pounding strokes. The outer sleeve annularly surrounds a substantial upper portion of the post for similar reasons. The outer sleeve transmits pounding strikes to a stop formation that rests stationary on the post's top end. That way, a user manually applying pounding strokes to the stop formation's upper surface transmits force to not only the post's top end but also the guide shaft's bottom end. Optionally, the guide shaft's bottom end is tipped and sticks out a little in order to pierce a pilot hole in the ground, and clear a path, for the post to follow.

11 Claims, 9 Drawing Sheets

COMBINATION POST AND INSERTION TOOL THEREFOR

CROSS-REFERENCE TO RELATED APPLICATION(S)

This application claims the benefit of U.S. Provisional Application No. 61/336,800, filed Jan. 27, 2010.

This application is a continuation in part of U.S. patent application Ser. No. 12/459,028, filed Jun. 25, 2009 now abandoned, which claims the benefit of U.S. Provisional Patent No. 61/133,045, filed Jun. 25, 2008. All the foregoing disclosures are incorporated by this reference thereto.

BACKGROUND AND SUMMARY OF THE INVENTION

The invention generally relates to hollow posts and drivers therefor and, more particularly, to a combination post and insertion tool which supports the post and transmits the impacts from a hammer during insertion of the post (driving of the post) into the ground.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

DETAILED DESCRIPTION OF THE PREFERRED EMBODIMENTS

Figure 1:
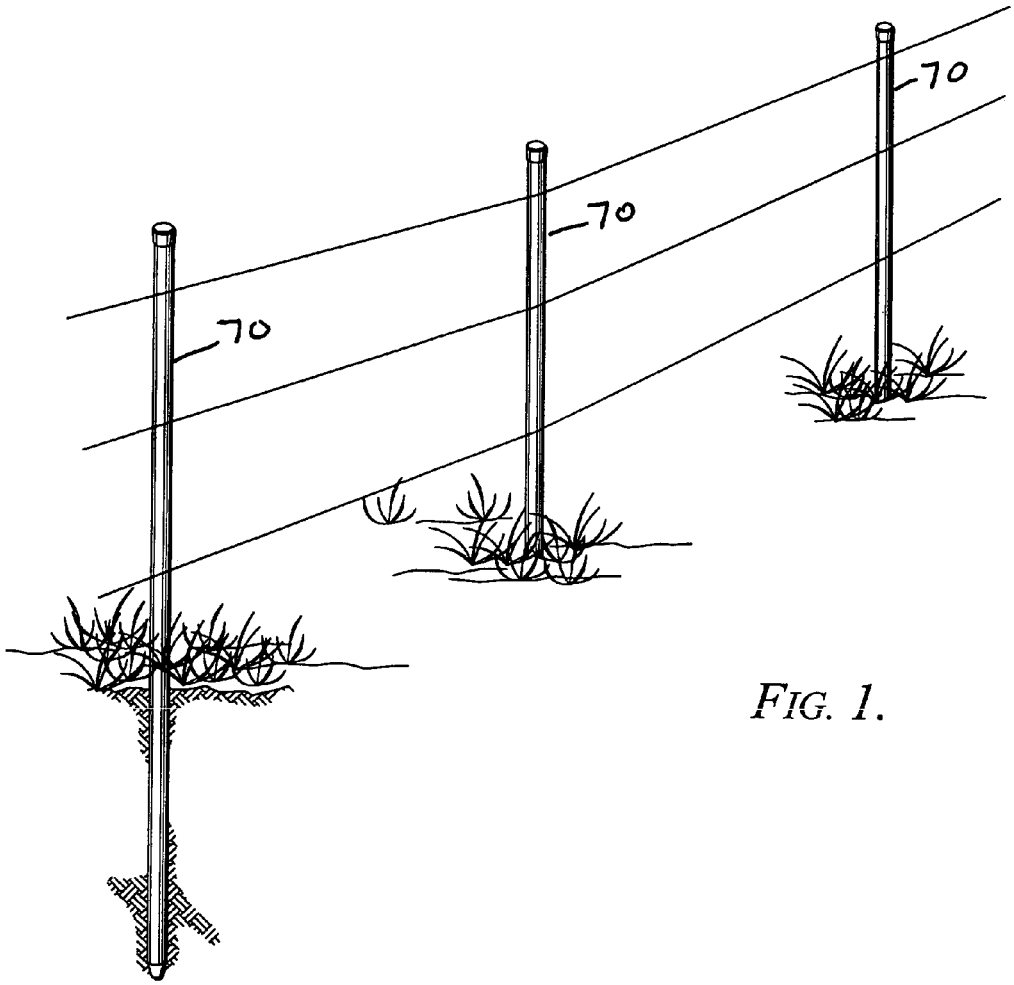
FIG. 1 is a perspective view of a row of posts in accordance with the invention for forming a fence line as a matter of illustrating an example end use of the posts.

FIG. 1 shows a row of posts 70 in accordance with the invention forming a fence line. This view is included as a matter of illustrating an example end use of the posts 70. The fence line might be electric. More significantly, the fence posts 70 will be un-typically flexible.

There is one installation of these fence posts 70 in accordance with the invention on a farm that uses a large-scale type of irrigation system known as a center-point pivot system. Center-point pivot irrigation is a form of sprinkler irrigation consisting of several segments of pipe (usually galvanized steel or aluminum) joined together and supported by trusses on wheeled towers, maybe eight to ten feet (~two-and-a-half to three meters) tall. In other words, the wheeled tower should have ample enough height so that the trusses can clear the crop height of, for example, corn. Sprinklers are positioned along the length. The system moves in a circular pattern and is fed with water from the pivot point at the center of the arc. These systems are found and used in all parts of the nation and allow irrigation of all types of terrain.

The tires are heavy. They are nearly truck tires (more likely, trailer tires). On this particular farm, the farmer just runs the wheeled towers right over the fence line. The fence posts 70 in accordance with the invention yield by bending over on their side until pretty much flattened out on the ground. Then, once the wheeled-towers have passed, the fence posts 70 spring back up and restore themselves to their original upright posture.

It is an aspect of the invention that the fence posts 70 are a specially blended material in order to enable this characteristic thereof.

Figure 2:
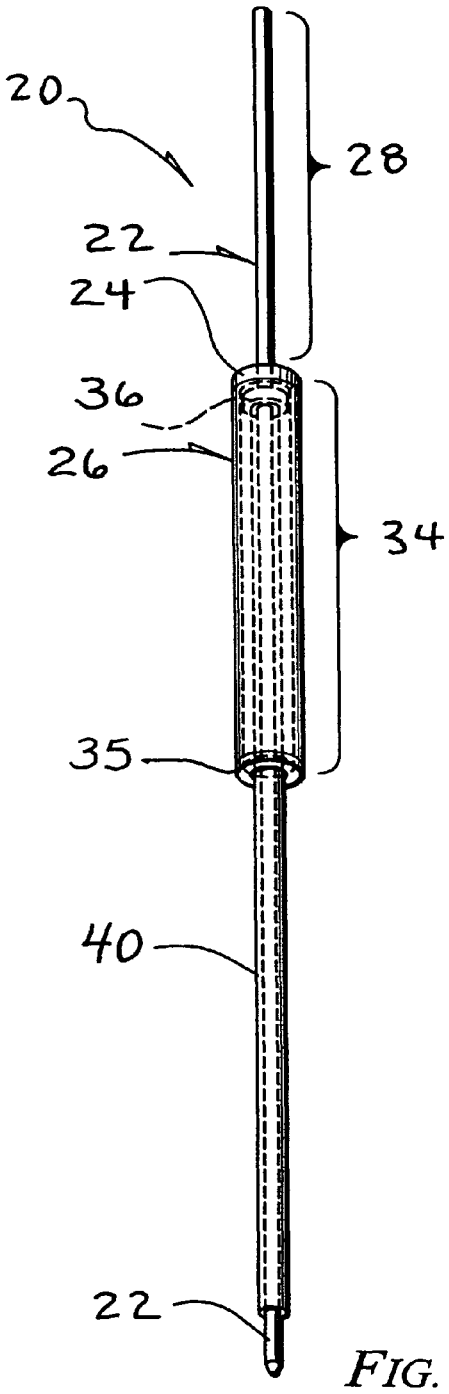
FIG. 2 is an enlarged-scale perspective view of a first embodiment of post driving apparatus in accordance with the invention, with a post to-be-driven shown to illustrate operative use.
Figure 3:
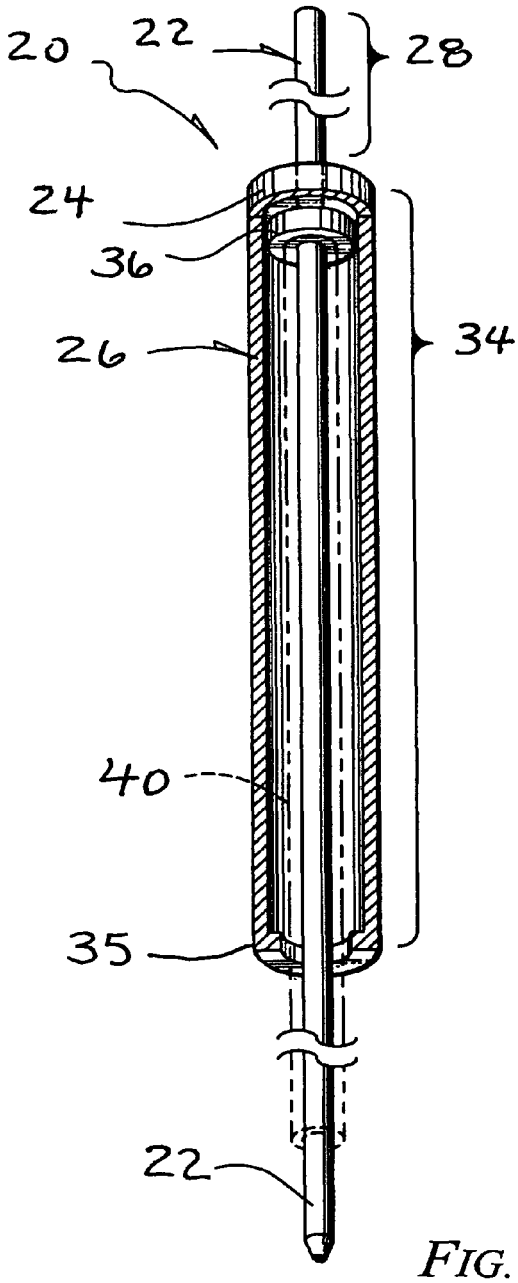
FIG. 3 is a further perspective view thereof except on an enlarged scale and with intermediate portions broken away at two places to foreshorten the view.

FIGS. 2 and 3 show the first embodiment of post driving apparatus 20 in accordance with the invention. The post driving apparatus 20 comprises a central guide shaft 22 and combination anvil/outer sleeve 24/26 which slides on the central guide shaft 22 between upper and lower extremes. It is preferred that the post driving apparatus 20 be used to drive hollow posts (eg., 40) into the ground whether they be metal or plastic. The invention is particularly advantageous for plastic posts in that the central guide shaft 22 is designed to insert inside the full length of the hollow core of the plastic post (eg., 40) and thereby provide protection against buckling under the force of the pounding strokes. In this embodiment, the combination anvil/outer sleeve 24/26 is the drive weight that pounds the post 40 into the ground. The guide shaft 22 not only provides temporary rigidity to the post to-be-driven 40 while being pounded but also pierces a pilot hole in the ground (this is not shown) for the post 40 to follow, thereby clearing a path for the post 40. The guide shaft 22 also provides a track portion 28 for the combination anvil/outer sleeve 24/26 to slide on during pounding strokes.

The outer sleeve 26 is preferably produced from a heavy-gauge metal pipe. The anvil 24 is preferably produced from a heavy, metal bushing. That is, the anvil 24 is a thick-walled cylinder (ie., bushing) extending between annular ends or faces. It is preferred that the outer sleeve 26 be about twenty inches long or, in other words, sufficiently long for ample up-and-down sliding strokes. The anvil 24 (bushing) is preferably a fraction of the length of the outer sleeve 26, perhaps something like three inches long. The anvil 24 (bushing) preferably has an outer diameter that closely nests inside the outer sleeve 26's hollow core. The anvil 24 (bushing) preferably has an inner diameter that allows sliding travel up and down on the guide shaft 22, as between extremes more particularly described below. The anvil 24 (bushing) is fixed in and/or welded to the outer sleeve 26 at one end of the outer sleeve 26, with one annular end about flush with one end of the outer sleeve 26, and the other annular end or face defining the pounding face for delivering the pounding force. The remaining extent of the outer sleeve 26 not occupied by the anvil 24 (bushing) forms sort of a skirt portion 34 therefor.

The outer sleeve 26 extends axially between the one end with the anvil 24 therein and an another end with an annularly inward flange portion 35 that is axially-spaced away from the anvil24. FIG. 3 that this annularly inward flange portion 35 is sized to closely surround the post 40's outer sidewall The annularly inward flange portion 35 of the outer sleeve 26 should be sized to let the post to-be-driven 40 pass freely through during the up-and-down sliding strokes, but not the anvil 24. That is, the anvil 24's annular driving face is what delivers the applied pounding force that gets transmitted to the post 40. In other words, the inner diameter of the anvil 24's hollow core is less than that of the post 40, and hence the post 40 gets driven instead of passed through. Correspondingly, the inner diameter of the anvil 24's hollow core is greater than that of the guide shaft 22, which allows free sliding travel on the track portion, 28 thereof. The track portion 28 guides the path of the anvil 24 and keeps it aimed on target for the top of the post to-be-driven 40.

The guide shaft 22 is preferably produced from a solid metal rod that extends between a lower tip end and an upper butt end. The tip end is somewhat sharpened, not too much so to present a danger to users but sufficiently so to pierce the ground with pounding strokes. Indeed, it is preferred to sharpen the tip end into a cone, either with or without flats or flutes (none shown). In this embodiment, the guide shaft 22 acts as a guide for the combination anvil/outer sleeve 24/26 and a stabilizer for the post. It is preferred that the length of the guide shaft 22 be the sum of (A) the length of the post to-be-driven 40 plus (B) a length corresponding to about an inch less than the length of the outer sleeve 26.

For example and without limitation, assume a post driving apparatus 20 in accordance with the invention sized to sink a four foot long plastic post (eg., 40) about one foot into the ground. Assume further that the outer sleeve 26 is about twenty inches long, and the anvil 24 plugs about the last three inches of the outer sleeve 26 (which, as an aside, leaves a skirt portion 34 that is about seventeen inches long). Given the foregoing, the length of the guide shaft 22 should be the sum of (A) four feet, the length of the post to-be-driven 40, and that's not including the measure of the guide shaft 22's tip end's cone section, plus (B) about nineteen more inches at the top, which is a short measure (~one inch) less than the twenty inch length of the outer sleeve 26. This nineteen more inches serves as the track portion 28 of the guide shaft 22 for the anvil 24 to slide up and down on.

The guide shaft 22 further includes a stop collar 36 welded to it at the transition between the height of the post to-be-driven 40 (eg., the four foot elevation) and the slide track portion 28 (eg, the about nineteen more inches). The collar 36 has an outer diameter slightly less than the outer sleeve 26's skirt portion 34's inner diameter so that the skirt portion 34 can freely pass by this stop collar 36 during the up and down sliding strokes. The collar 36 might also be fairly thin, and therefore more nearly resemble a washer. As for the anvil 24, however, this stop collar 36 defines the lower limit of the anvil 24's downstroke (ie., pounding stroke). In use, it is preferred that the stop collar 36 is rested against the post to-be-driven 40's top end. That way, the pounding strokes of the anvil 24's pounding face are delivered directly to the stop collar 36, which directly transmits the force of the pounding stroke to the post 40's top end. In other words, the anvil 24's pounding face does not directly strike the post 40's top end, but the stop collar 36 (which, as said, rests on the post 40's top end).

The guide shaft 22 might optionally include a cap or retainer at its upper end (not shown) when stood vertically. The retainer might be a round metal disc welded or bolted to the guide shaft 22's top end (again, this is not shown). When the retainer is included, it will serve as the anvil 24's upper (travel) limit during the up stroke (eg., the back or retraction stroke). It is also preferred that the guide shaft 22's sharpened tip end project out the post 40's bottom end so that the guide shaft 22's conic tip end forms a smooth tip end for the post 40 as a whole (again, with the post 40's top end abutted against the stop collar 36 at the bottom of the track portion 28 of the guide shaft 22). That way, with the guide shaft 22 inserted through the whole length of the post to-be-driven 40, the guide shaft 22's tip end will do the actual piercing into the ground and thereby save the post 40's bottom end from unwanted damage. The guide shaft 22's sharpened end will aid in an easier driving through the ground.

To drive the post 40 into the ground, the guide shaft 22 is inserted inside the post 40, with the stop collar 36 bottoming out on the post 40's top end, the guide shaft 22's tip end poking out the post 40's bottom end. Then the user sets the post 40 up vertically on the ground where it is desired to be driven by the user (not shown), with the guide shaft 22's tip end resting on the ground at the point of entry (again, not shown). As a result, the guide shaft 22's track portion 28 (eg., the upper nineteen inches in the example) will extend upwardly out of the post 40's top end. This track portion 28 shall be the 'guide' or track portion 28 for the path of the combination anvil/outer sleeve 24/26 during the up-and-down sliding strokes. The remainder of the guide shaft 22 inside the post 40 will act as a stabilizer for the post 40, providing the post 40 with rigidity against buckling while being driven.

The outer sleeve 26's skirt portion 34 passes freely past the stop collar 36 and the post 40's outer sidewall—until the anvil 24's pounding face comes to rest on the fixed stop collar 36. Now the user can slide the anvil 24 between up and down sliding strokes, thrusting each down stroke with force as a pounding stroke to deliver a pounding blow to the stop collar 36, which directly transmits the force to not only the post 40's top end but more significantly to the guide shaft 22's tip end. The user continues with pounding strokes alternated with retraction (back) strokes, progressively driving the tip end of the guide shaft 22 deeper into the ground, with the post 40 directly following.

Again, to drive the post 40 into the ground, the user grasps the outer sleeve 26 of the combination anvil/outer sleeve 24/26. The user hoists the combination anvil/outer sleeve 24/26 up vertically for a back (or retraction) stroke, and then thrusts the combination anvil/outer sleeve 24/26 down for a pounding stroke. Since the guide shaft 22 is inserted through the central bore in the anvil 24, the combination anvil/outer sleeve 24/26 should stay tracking on the guide shaft 22. As further assurance of this, the outer sleeve 26's skirt portion 34 should track on the stop collar 36 concurrently with the annularly inward flange portion 35 on the upper portions of the post 40's outer side wall, which should further help prevent the anvil 24 from binding on the track portion 28 of the guide shaft 22. This will keep the combination anvil/outer sleeve 24/26 moving straight on the central axis of the guide shaft 22 (and post 40 as well) during the pounding and retraction stroke, without getting crooked. Staying on axis is important for driving the post 40 in straight or otherwise not damaging the post 40. Also, the retainer on the upper end of the guide shaft 22 (if used, and not illustrated) will prevent the user from backing the combination anvil/outer sleeve 24/26 off too high or, that is, limit the combination anvil/outer sleeve 24/26 from sliding off the top of the guide shaft 22 completely.

The user should thrust the combination anvil/outer sleeve 24/26 down the guide shaft 22 upon the stop collar 36 with force. The weight of the combination anvil/outer sleeve 24/26 acts as the pile-driving weight. The pounding upon the collar 36 will drive the guide shaft 22's tip end into the ground. Since the combination anvil/outer sleeve 24/26 is purposely heavy, it is easy for the user to generate a lot of force to pound the post into the ground without much exertion. That is, the user to relies partly upon the gravity to assist his or her own exertions. The placement of the stop collar 36 between the anvil 24's pounding face and the post 40's top end acts as a barrier between the anvil 24 and post 40. This will prevent the anvil 24 from shattering or otherwise damaging the post 40.

Pounding strokes are applied until the post 40 is driven into the ground to the desired depth, of about a foot or whatever. When the user is finished, all he or she must do is remove the guide shaft 22 from the ground and post 40 by sliding it out the top end of the post 40.

Figure 4:
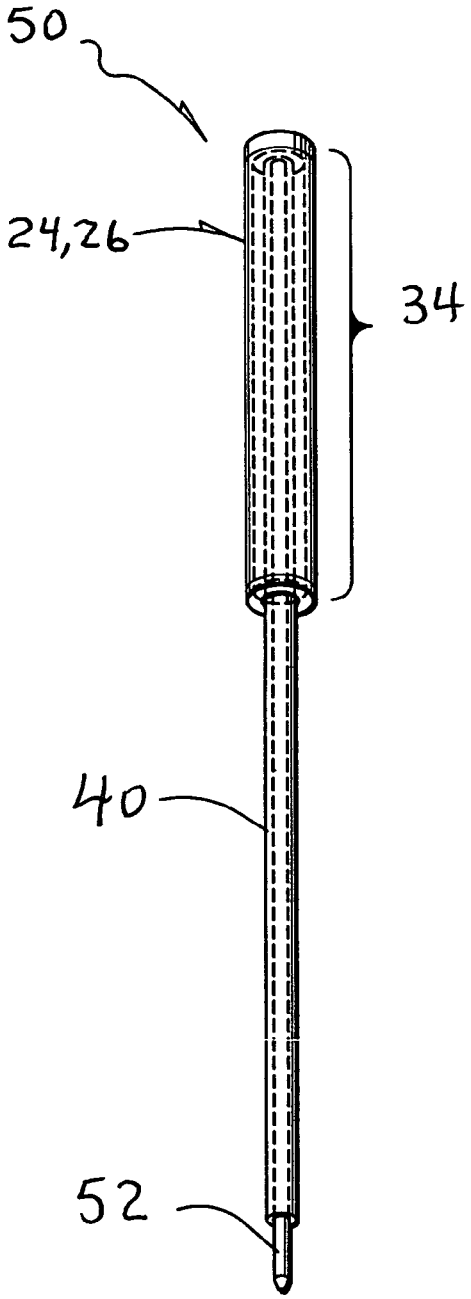
FIG. 4 is a perspective view of comparable to FIG. 1 except of a second embodiment of post driving apparatus in accordance with the invention, with a post to-be-driven likewise shown to illustrate operative use.
Figure 5:
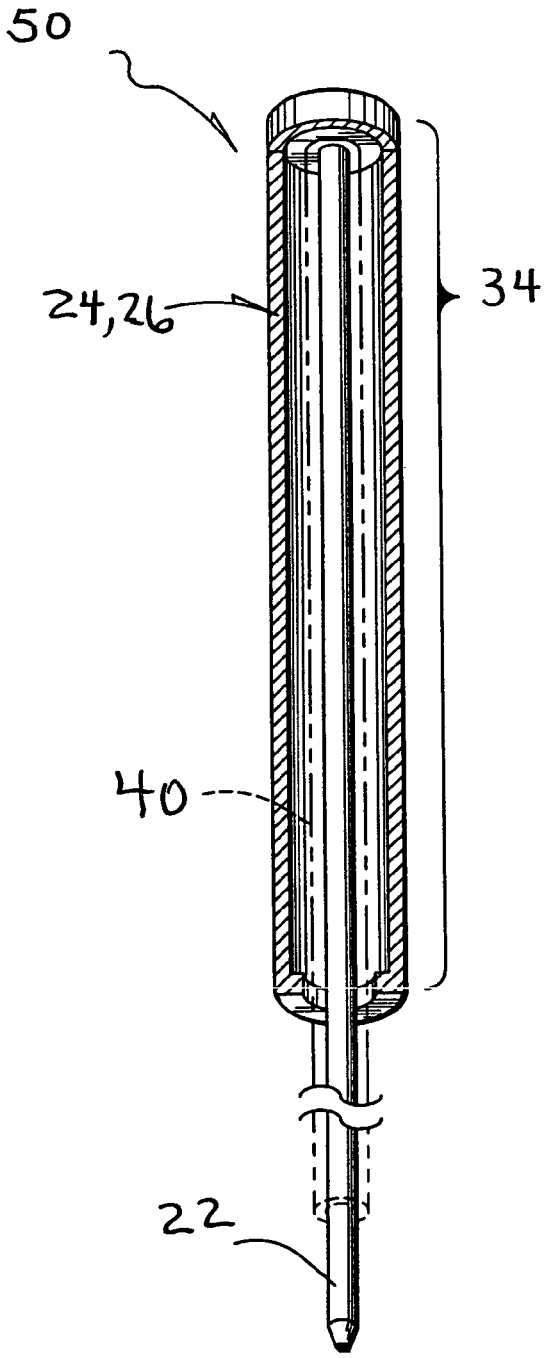
FIG. 5 is a further perspective view of the FIG. 4 embodiment except on an enlarged scale and with intermediate portions broken away at one place to foreshorten the view.

FIGS. 4 and 5 show a second embodiment of post driving apparatus 50 in accordance with the invention. In this embodiment, the guide shaft 52 has the combination anvil/outer sleeve 24/26 fixed to it. The anvil 24 is fixed to the guide shaft 22, that is, with the anvil's pounding face fixed at the elevation of the stop collar 36 of the FIG. 2 embodiment (which is eliminated in this embodiment). The anvil 24 can be fixed to the guide shaft 22 by welding or the like.

The excess portions of the guide shaft 52—which in the FIG. 2 embodiment of the guide shaft 22 serve as the track portion 28—are another difference in this embodiment, because they are eliminated. Hence the guide shaft 52 is relatively abbreviated compared to the guide shaft 22. The guide shaft 52 inserts all the way into the post to-be-driven 40 as shown, with the sharpened tip end projecting from the post 40's bottom end while the anvil 24's pounding face rests on the post 40's top end.

In contrast to FIG. 2, the guide shaft 52 here only serves as a stabilizer for the post 40. More significantly, the combination anvil/outer sleeve 24/26 does not reciprocate relative the post to-be-driven 40 (or the guide shaft 52 either) during use.

Figure 6:
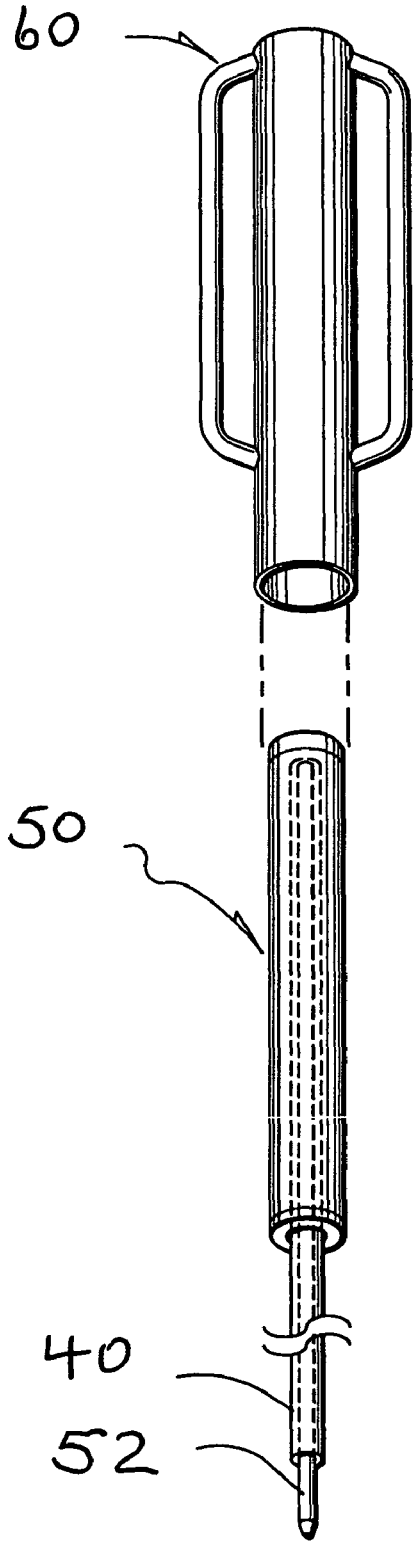
FIG. 6 is a reduced scale, exploded perspective view of the post driving apparatus in accordance with FIG. 4 embodiment in combination with a T-Post driver of the prior art, wherein portions of the post to-be-driven are broken away at one place to foreshorten the view.
Figure 7:
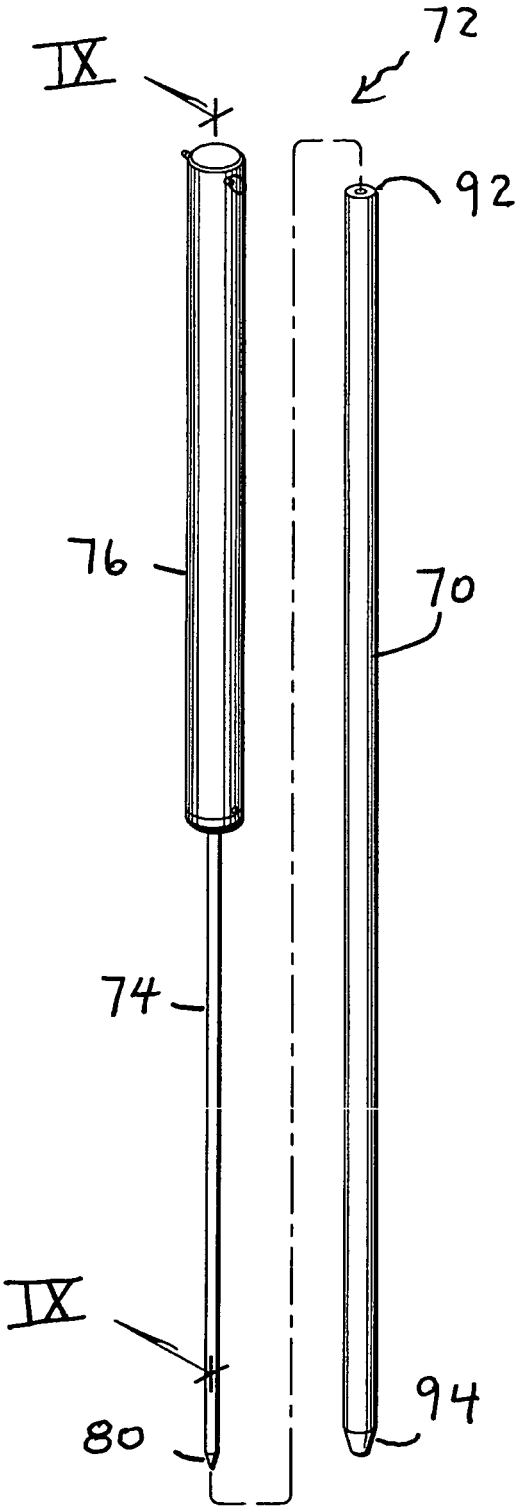
FIG. 7 is an exploded perspective view of an alternate embodiment of a combination post and insertion tool therefor in accordance with the invention.
Figure 8:
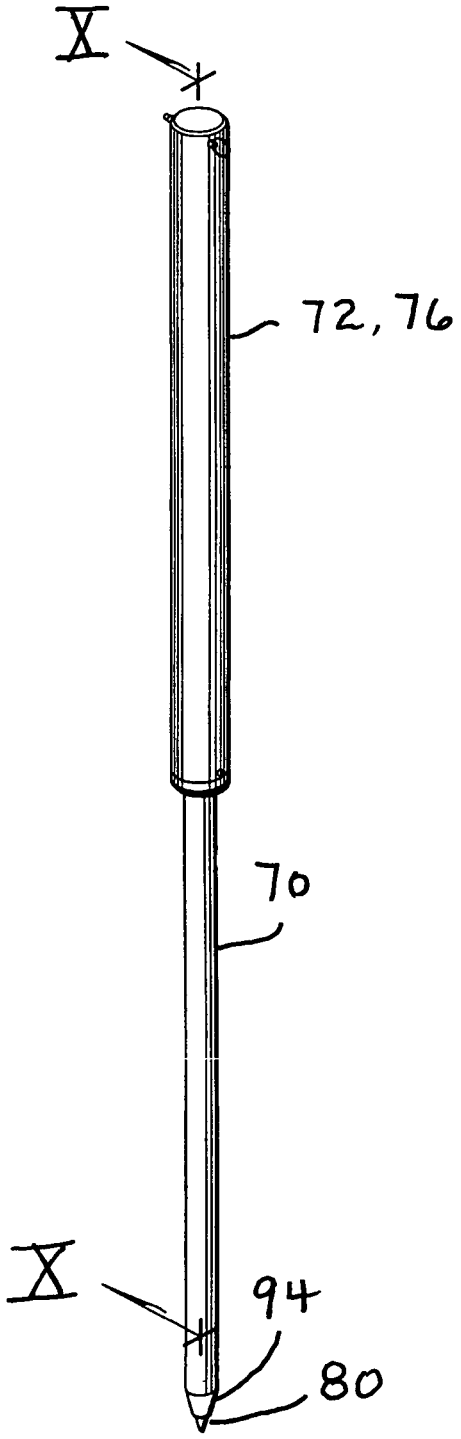
FIG. 8 is a perspective view comparable to FIG. 7 except the post and insertion tool coupled together.

Instead, as FIG. 6 shows, the pounding action is delivered by a conventional, T-post driver 60 in accordance with the prior art, such as and without limitation like what is disclosed by U.S. Pat. No. 2,098,146-Hunt, the disclosure of which is incorporated herein by this reference. The conventional T-post driver 60 slips over the outer sleeve 26 and is utilized to pound this embodiment of the post driving apparatus 50 as a unit in unison with the post to-be-driven 40. As soon as the post to-be-driven 40 is sunk into the ground to the desired depth (not shown), the conventional T-post driver 60 is set aside. Then this embodiment of the post driving apparatus 50 is withdrawn completely, out through the top of driven post (this is not shown). Again, the guide shaft 52 stabilizes the post 40 and is driven along with the post 40 into the ground, after which the user then extracts the post driving apparatus 50 as a whole when finished.

FIGS. 7 through 10 show an alternate embodiment of a combination post 70 and insertion tool 72 therefor in accordance with the invention.

The insertion tool 72 comprises an elongated spike 74 and an abbreviated outer sleeve 76 telescoped over the top end 78 of the spike 74. The spike 74 extends between a butt end 78 and conically-tapered pointed end 80. The outer sleeve 76 extends between a lower open end 82 and top end 84 plugged by an anvil 86.

Figure 9:
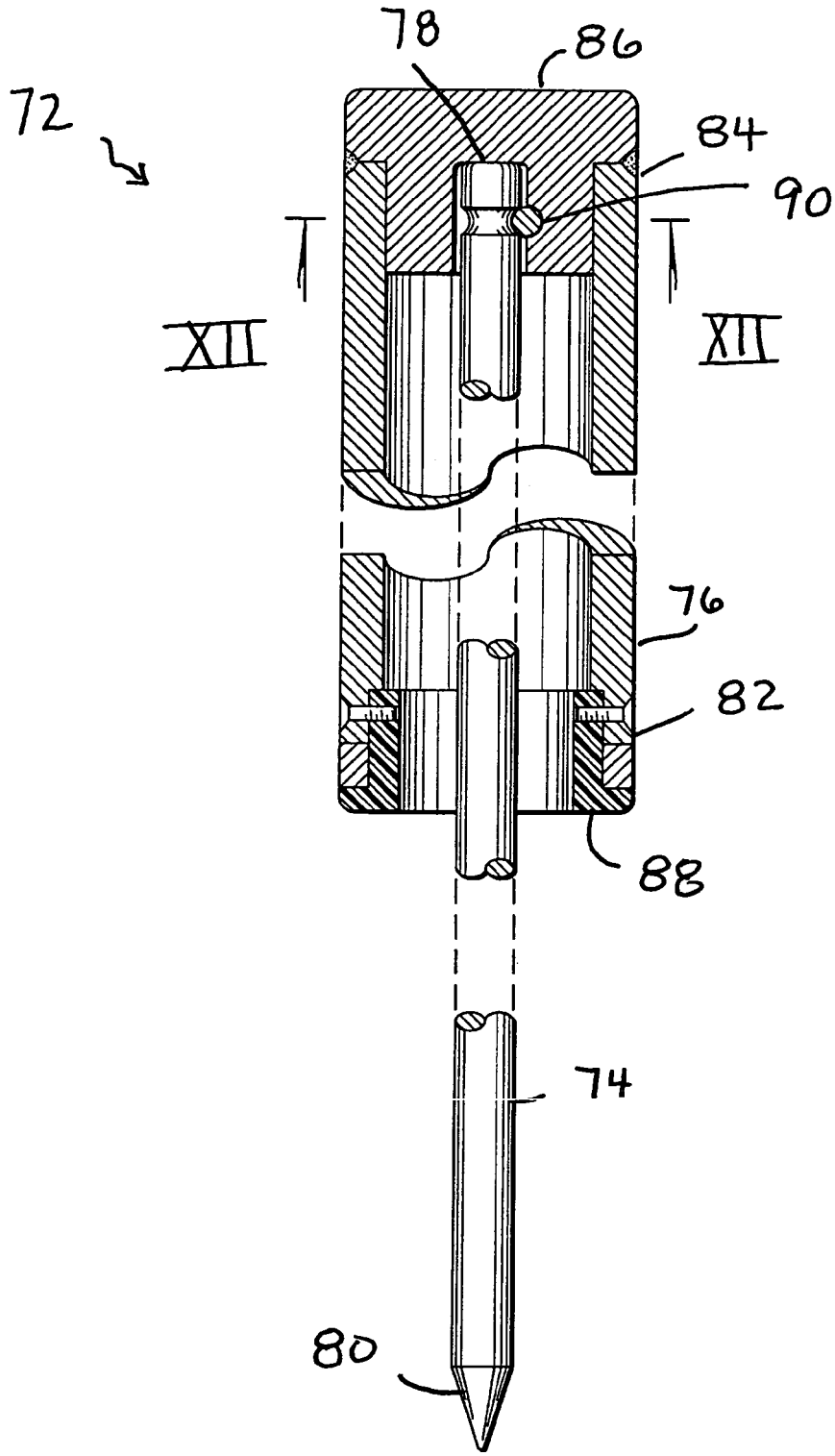
FIG. 9 is an enlarged scale partial sectional view taken along line IX-IX in FIG. 7 (ie., with the post not shown), and the spike foreshortened.
Figure 10:
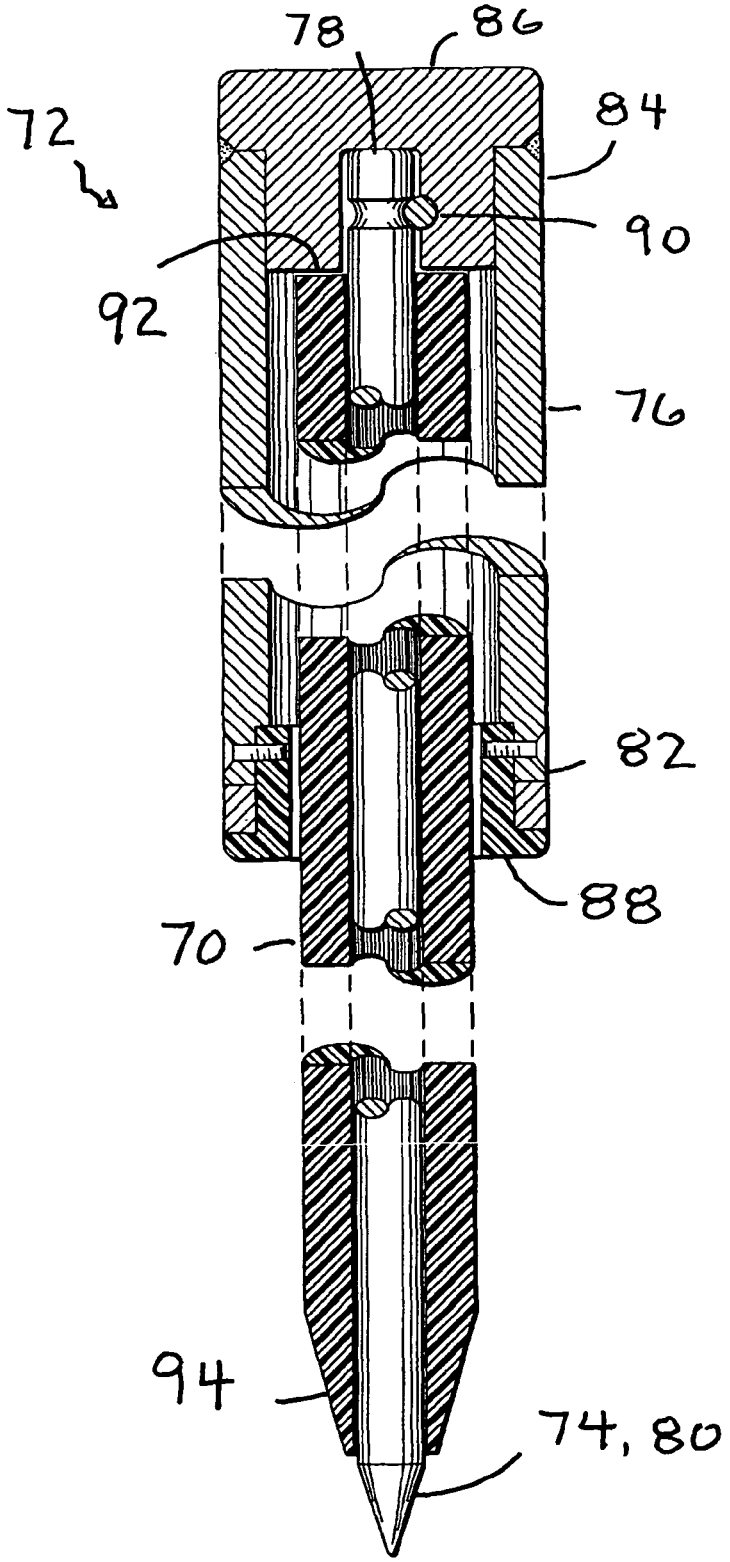
FIG. 10 is an enlarged scale partial sectional view taken along line X-X in FIG. 8 (ie., with the post indeed shown), and the spike and portions of the post foreshortened.

The anvil 86 interconnects the outer sleeve 76 and spike 74. The anvil 86 and outer sleeve 76 are preferably produced of steel that accepts welds. The spike 74 is preferably made of the same material. FIG. 9 shows that the outer sleeve 76's open bottom end 82 is lined with a scuff-protecting ring 88. FIG. 10 shows that the purpose of the scuff protecting ring 88 is to protect the post 70 from being marked and scuffed during use.

Optionally, the anvil 86 and outer sleeve 76 are permanently fixed together. Preferably, the central spike 74 and anvil/outer sleeve unit 86/76 are releasably coupled together. FIGS. 7 through 10 and FIG. 12 show a system comprising a quick release pin 90. One advantage of the foregoing is to allow the exchange of one spike 74 of one length and/or diameter for another spike 74 of another length and/or diameter, and in accordance with the length and diameter of the given post 70.

The post 70 is relatively slender and hollow and also, like the spike 74, is elongated between spaced ends 92 and 94, one comprising an open top end 92 and the other comprising an open pointed end 94. Whereas this hollow post 70 is indeed relatively slender, it comprises substantial wall thickness. Indeed, for buckling and bending analysis, it might qualify for short column status (in contrast to long column).

Engineers typically perform buckling (bending) analysis according to the 'area' or 'second' moment of inertia.

Applicant typically prefers a post with a Modulus of Elasticity in Bending (MOE) in the range of 250,000 psi, and a Modulus of Rupture in Bending (MOR) in the range of 4,000 to 4,500 psi.

Wherein, the 'area' or 'second' moment of inertia "$I_a$" equals:

$$I_a=(\pi/4)\cdot(r_o^4-r_i^4) \tag{1}$$

$r_o$=outside radius, $r_i$=inside radius.

The radius of gyration "$R_g$" equals:

$$(R_g)^2=I_a/A. \tag{2}$$

The critical force "F" to buckling equals:

$$F=(\pi^2\cdot E\cdot I_a)/(K\cdot L)^2 \tag{3}$$

E=elastic modulus

L=length, and

K=factor changing true length to an effective length, & according to end restraint or not.

The Modulus of Rupture in Bending (MOR) is given by:

$$\mathrm{MOR}=(1.75)(P)(\mathrm{O.D.})/(I_a). \tag{4}$$

P=pressure of applied load, and

O.D.=outside diameter.

However, the post 70 need not withstand all the impact of the T-post driver 60 without help. That is, the insertion tool 72 in accordance with the invention provides support against buckling and fragmenting under the impacts of the T-post driver 60.

It is an aspect of the invention that the combination in accordance with the invention of this post 70 and this insertion tool 72 are only matched together about once in the life of the post 70. And that one time is, needless to say, at the instance of driving this post 70 into the ground.

Figure 11:
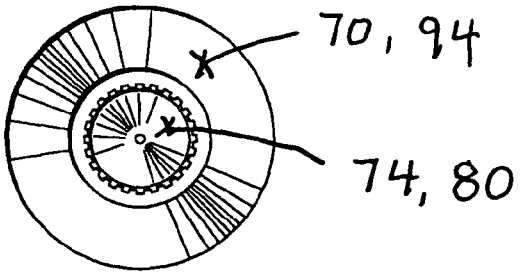
FIG. 11 is an enlarged scale bottom plan view of FIG. 8.
Figure 12:
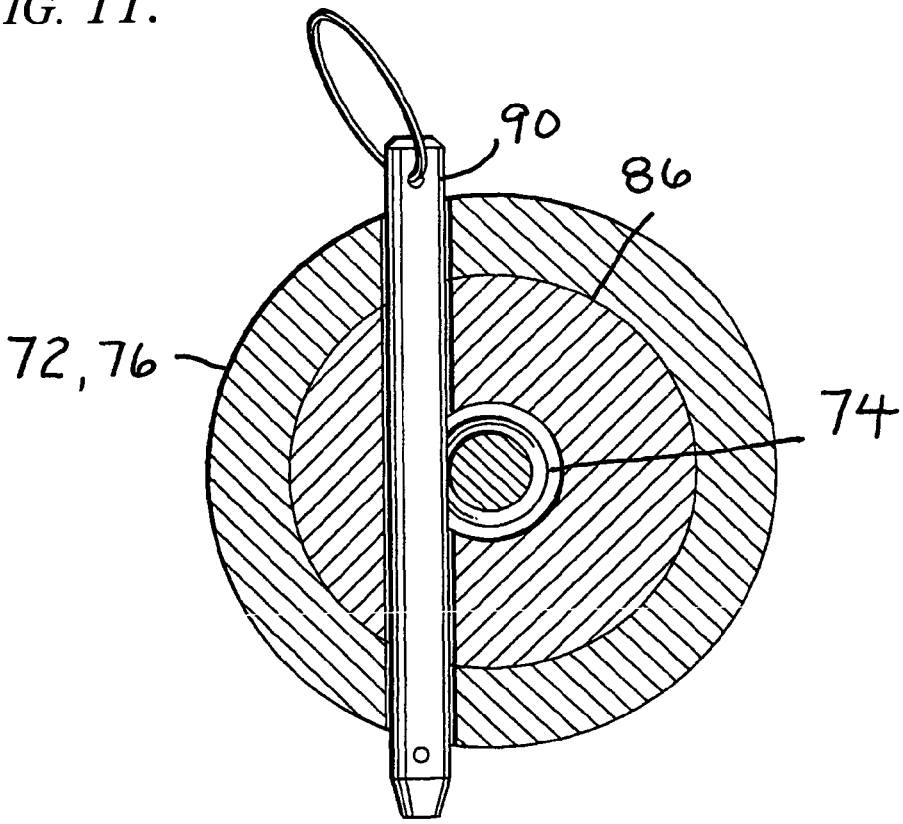
FIG. 12 is a sectional view taken along line XII-XII in FIG. 9 and on an enlarged scale; and, FIG. 13 is an enlarged scale detail view taken from the sectional view of FIG. 10 and showing the post and spike of the insertion tool therefor cooperatively working together while being driven through rocky ground.
Figure 13:
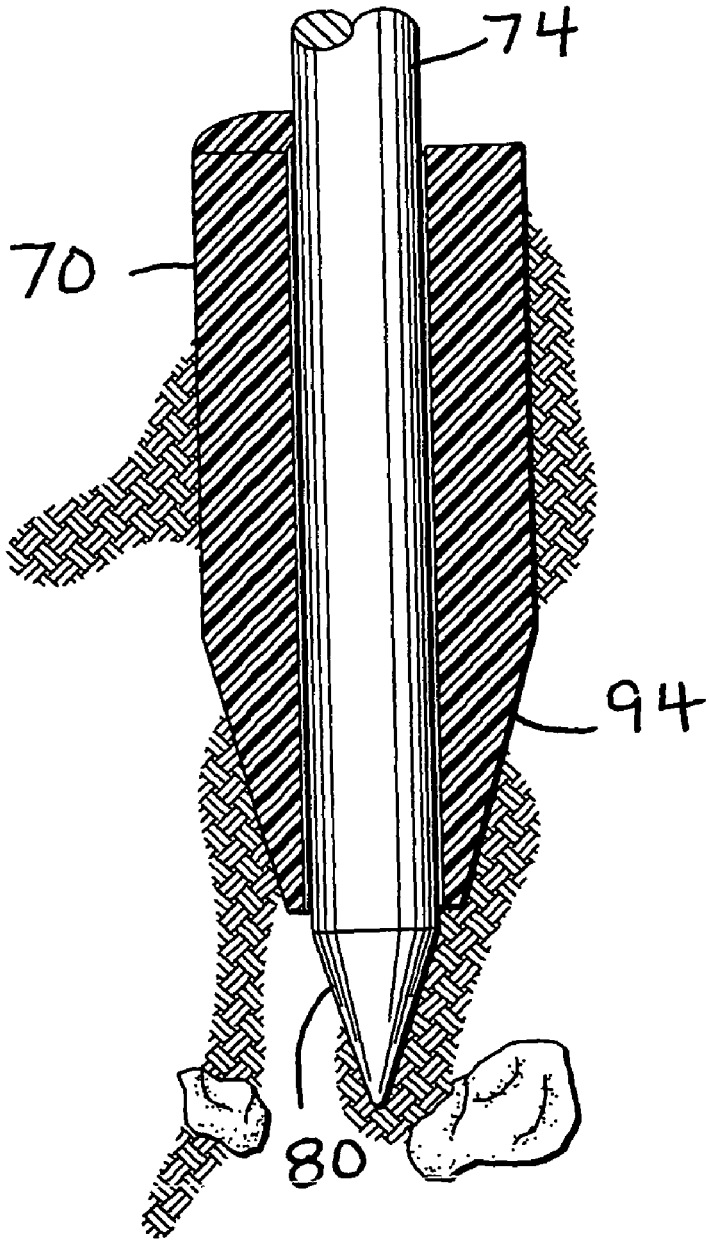

FIGS. 10 and 13 show that the lengths of the post 70 and spike 74 are selected correspondingly so that the post 70's open pointed end 94 aligns with the spike 74's pointed end 80 so as to form a nearly smooth continuation thereof. Likewise, FIGS. 10 and 13 along with FIG. 11 show better that the outside diameter of the spike 74 is chosen to closely fill the inside diameter of the post 70's hollow core. Again, both the bottom of the post 70 and bottom of the spike 74 are conically tapered, and preferably as close to the same angle as practical. The length of the post 70 should be shorter than the spike 74 so that the open tapered end 94 of the post 70 more or less meets the spike 74's transition point where the pointed end 80 transitions into the spike 74's cylindrical sidewall. That way, the spike 74's pointed end 80 is exposed beyond the post 70's bottom end 94. The taper of the post 70's tapered end 94 begins where the taper of the spike 74's pointed end 80 leaves off.

When the central spike 74 is inserted inside the post 70, these two tapered formations are meant to work with each other so that they form a fairly continuous uniform conic taper with each other in unison. This is shown best in FIG. 13.

Again, FIG. 13 shows better the following. That, the close matching match-up between the length as well as taper of the spike 74 and the length as well as taper of the post 70 allows for easier piercing of rocky ground, and driving into the ground, when the post 70 is being driven. The ground spike 74 has a hardened pointed end 80 and can push aside aggregate in the soil that the plastic post 70 could not. In the absence of the spike 74, a direct strike into a rock might shatter the plastic post 70 or overcome the critical buckling strength of the plastic post 70 alone. But not so in accordance with the invention. The pointed end 80 of the steel spike 74 might do any of the following:

push the rock aside, steer the course of the post 70 around the rock, do a bit of both, or stop downward progress in its tracks, without destruction of the plastic post 70. In the last case scenario, the post 70 and spike 74 of the insertion tool 72 can be pulled out (withdrawn) for another try. The spike 74 can be used alone for a while to probe the ground for a pathway around the obstructing rock. Given the new spot, the post 70 can be re-driven into the ground except this time into the new spot. The pointed end 80 will lead the way. The spike 74 will stiffen the post 70 against buckling.

During the instances where the spike 74's hardened pointed end 80 moves a rock aside, the plastic post 70's tapered open end 94 has sufficient compression strength to continue the pushing aside of the rock, being reinforced on the inside sidewall by the steel spike 74, to produce an applied force against the aggregate normal to the angle of the taper.

Again, with the plastic post 70 experiencing a compressive force between the inside spike 74 and the outside aggregate, the plastic post 70 has sufficient compressive strength to withstand this.

The post 70 also has thick walls and an inside diameter such that the central guide shaft fills the hollow core for a close fit.

After the post 70 has been driven to the desired depth (as shown by FIG. 13), the insertion tool 72 is withdrawn, and the post 70 remains.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. Combination of elongated slender hollow plastic posts (40,70) with an insertion tool (20) that forms three axially-spaced tracking provisions for better staying on axis and driving the posts (40,70) straight into the ground, said combination (20 and 40,70) comprising:

a plurality of elongated slender hollow plastic posts (40,70) axially elongated between an upper open end (92) and a lower open end (94), said posts (40,70) having a uniform length and having an annular sidewall, which defines a hollow core and an outer skin therefor;

said insertion tool (20) comprising:

an elongated slender guide shaft (22) extending axially between an upper end and a spaced away bottom end (80);

a radially-enlarged stop formation (36) providing upper and lower stop surfaces and being fixed on the guide shaft (22) between the ends thereof to define a transition for the guide shaft (22) between an elongated slender track portion (28) thereof terminating in the upper end and an elongated slender insertion portion (52,74) terminating in the bottom end (80);

an outer sleeve (26,76) extending axially between an upper end (84) and an axially-spaced away annularly inward flange portion 35, said outer sleeve (26,76) including an anvil (24) that is formed with an axial through-hole and is affixed in or across the upper end (84), said outer sleeve (26,76) defining between said anvil (24) and said annularly inward flange portion (35) a skirt portion (34);

wherein the track portion (28) of the guide shaft (22) inserts through the through-hole of the anvil (24) for sliding thereon between upper and lower extremes;

wherein the through-hole of the anvil (24) is sized to allow the track portion (28) to slide freely therein but not the stop formation (36) such that the anvil (24) has a lower apertured driving face adapted for pounding the upper stop surface of the stop formation (36), whereby the meeting therebetween defines the lower travel extreme;

wherein the insertion portion (52,74) has a length and cross section sized to pass reversibly through but generally occupy the hollow core of the posts (40,70) from end to end (92 to 94) to provide protection against the posts (40,70) from buckling under force of pounding strokes; and wherein the skirt portion (34) has a hollow-core cross-section sized for freely sliding up and down as well as past both the stop formation (36) and the outer skin of the posts (40,70);

wherein the annularly inward flange portion (35) has a hollow-core cross-section sized for the annularly inward flange portion (35) to slide freely up and down the outer skin of the posts (40,70);

whereby a user manually handling the outer sleeve (26,76) delivers pounding strokes between the anvil (24) and stop formation (36), such that the stop formation (36) transmits force to not only the post (40,70) on the upper open end (92) thereof, but also to the guide shaft (22) and ultimately the bottom end (80) thereof;

said insertion tool (20) forming three axially-spaced tracking provisions for better staying on axis and driving the posts (40,70) straight into the ground, comprising:

sliding contact between the anvil (24) and guide shaft (22), sliding contact between the skirt portion (34) and stop formation (36), and sliding contact between the annularly inward flange portion (35) and outer skin of the post (40,70).

2. The combination (20 and 40,70) of claim 1 wherein:

the insertion portion (52,74) comprises a length between the lower stop surface of the stop formation (36) and the bottom end (80) thereof which is slightly longer than the uniform length of the posts (40,70) such that, with the stop formation (36) resting on the upper open end (92) of one post (40,70), the bottom end (80) of the insertion portion (52,74) pokes out the lower open end (94) of said one post (40,70) and thereby leads said one post (40,70), piercing a pilot hole in the ground and clearing a path for said one post (40,70) to follow.

3. The combination (20 and 40,70) of claim 1 wherein:

said insertion portion (52,74) comprises an elongated sidewall, a tapered bottom end (80), and a transition therebetween;

said sidewall of the insertion portion (52,74) comprises a length between the lower stop surface of the stop formation (36) and said transition;

said length of the sidewall of the insertion portion (52,74) is sized to match or slightly exceed the uniform length of the posts (40,70) such that, with the stop formation (36) resting on the upper open end (92) of one post (40,70), the tapered bottom end (80) of the insertion portion (74) pokes out the lower open end (94) of said one post (40,70) and thereby leads said one post (40,70), piercing a pilot hole in the ground and clearing a path for said one post (40,70) to follow.

4. The combination (20 and 40,70) of claim 1 wherein:

the guide shaft (22) has a length comprising at least the sum of the uniform length of the posts (40,70) and the length of the outer sleeve (26,76), minus the length of the stop formation (36).

5. The combination (20 and 40,70) of claim 4 wherein:

said annularly inward flange portion (35) is sized and adapted to stop against the lower stop surface of the stop formation (36) to disallow complete withdrawal of the stop formation (36) from the outer sleeve (26,76).

6. Combination of elongated slender hollow plastic posts (40,70) with an insertion tool (50,72) for driving the posts (40,70) straight into the ground; said combination (40,70 and 50,72) comprising:

a plurality of elongated slender hollow plastic posts (40,70) axially elongated between an upper open end (92) and a lower open end (94), said posts (40,70) having a uniform length and having an annular sidewall, which defines a hollow core and an outer skin therefor;

said insertion tool (50,70) comprising:

an elongated slender guide shaft (52,74) extending axially between an upper butt end (78) and a spaced away bottom end (80);

an outer sleeve (26,76) extending axially between an upper end (84) and a lower scuff ring (88), said outer sleeve (26,76) including an anvil (24,86) that is formed with an axial through-hole and is affixed in or across the upper end (84);

said elongated slender guide shaft (52,74) being affixed in or to the anvil (24,86) proximate the upper butt end (78) thereof and substantially axially centered in the outer sleeve (26,76);

wherein the guide shaft (52,74) has a length and cross section sized to pass reversibly through but generally occupy the hollow core of the posts (40,70) from end to end (92 to 94) to provide protection against the post buckling under force of pounding strokes; and wherein the scuff ring (88) has a hollow-core cross-section sized for closely surrounding the outer skin of the post (40,70) and enabling not only sliding but also axially-tracking, contact therebetween, as well as for free insertion and withdrawal of the posts (40,70) by the upper open ends (92) thereof;

whereby a user applying manual pounding strokes to the insertion tool (50,70) with an auxiliary pounding tool (60) transmits force to not only a one post (40,70) on the upper open end (92) thereof but also to the guide shaft (52,74) and ultimately the bottom end (80) of said one post (40,70).

7. The combination (40,70 and 50,72) of claim 6 further comprising:

said auxiliary pounding tool (60), which comprises a T-post driver.

8. The combination (40,70 and 72) of claim 6 wherein:

the scuff ring (88) is removably attached to the outer sleeve (76) and is thereby adapted for interchange with a scuff ring having a different hollow-core cross-section geometry and/or size.

9. The combination (40,70 and 72) of claim 6 wherein:

the anvil (86) is removably attached to either the elongated slender guide shaft (74) or the outer sleeve (76) such that the elongated slender guide shaft (74) is thereby adapted for interchange with a guide shaft of different length and/or different cross-section geometry and/or size.

10. Combination of elongated slender hollow plastic posts (40,70) with an insertion tool (50,72) for driving the posts (40,70) straight into the ground; said combination (40,70 and 50,72) comprising:

a plurality of elongated slender hollow plastic posts (40,70) axially elongated between an upper open end (92) and a lower open end (94), said posts (40,70) having a uniform length and having an annular sidewall, which defines a hollow core and an outer skin therefor, said insertion tool (50,70) comprising;

an elongated slender guide shaft (52,74) extending axially between an upper butt end (78) and a spaced away bottom end (80);

an outer sleeve (26,76) extending axially between an upper end (84) and a lower scuff ring (88), said outer sleeve (26,76) including an anvil (24,86) that is formed with an axial through-hole and is affixed in or across the upper end (84);

said elongated slender guide shaft (52,74) being affixed in or to the anvil (24,86) proximate the upper butt end (78) thereof and substantially axially centered in the outer sleeve (26,76);

wherein the guide shaft (52,74) has a length and cross section sized to pass reversibly through but generally occupy the hollow core of the posts (40,70) from end to end (92 to 94) to provide protection against the post buckling under force of pounding strokes;

wherein the scuff ring (88) has a hollow-core cross-section sized for free insertion and withdrawal of the posts (40,70) by the upper open ends (92) thereof;

whereby a user applying manual pounding strokes to the insertion tool (50,70) with an auxiliary pounding tool (60) transmits force to not only a one post (40,70) on the upper open end (92) thereof but also to the guide shaft (52,74) and ultimately the bottom end (80) of said one post (40,70);

said elongated slender guide shaft (52,74) comprises an elongated sidewall, a tapered bottom end (80), and a transition therebetween;

said sidewall of the elongated slender guide shaft (52,74) comprises a length between said anvil (24,86) and said transition;

said length of the sidewall of the elongated slender guide shaft (52,74) is sized to match or slightly exceed the uniform length of the posts (40,70) such that, with the anvil (24,86) resting on the upper open end (92) of one post (40,70), the tapered bottom end (80) of the elongated slender guide shaft (52,74) pokes out the lower open end (94) of said one post (40,70) and thereby leads said one post (40,70), piercing a pilot hole in the ground and clearing a path for said one post (40,70) to follow.

11. The combination (70 and 50,72) of claim 10 wherein:

said posts (70) comprise an elongated outer skin terminating proximate the lower open end (94) in a transitional terminus, and further comprise a tapered section below the transitional terminus terminating in the open end (94); and the tapered section proximate the lower open end (94) of the post (70) is tapered to match the tapered bottom end (80) of the insertion portion (74) so as to form a nearly smooth continuation thereof (FIG. 13).

* * * * *